US005887816A

United States Patent [19]

Jones

[11] Patent Number: 5,887,816

[45] Date of Patent: Mar. 30, 1999

[54] DEREELER FOR SELECTIVELY FEEDING COILED STOCK INTO AN ASSOCIATED FABRICATING MACHINE

[75] Inventor: Johnnie L. Jones, Rockford, Mich.

[73] Assignee: Accra-Wire Controls Inc., Rockford, Mich.

[21] Appl. No.: 901,479

[22] Filed: Jul. 28, 1997

[51] Int. Cl.[6] ..... B65H 16/04; B65H 23/185

[52] U.S. Cl. ..... 242/420.6

[58] Field of Search ..... 242/420.6, 420.4, 242/420.3, 421.5, 421.6, 421.7, 421.8, 421.9, 417.3, 413.5

[56] References Cited

U.S. PATENT DOCUMENTS

| | | | |
|---|---|---|---|
| Re. 32,996 | 7/1989 | Takahashi | 242/420.6 |
| 500,541 | 6/1893 | Rhoades . | |
| 1,946,264 | 2/1934 | Baer . | |
| 2,246,363 | 6/1941 | Kellogg et al. . | |
| 2,603,428 | 7/1952 | Newcombe | 242/420.6 |
| 3,123,317 | 3/1964 | Clark et al. . | |
| 3,249,315 | 5/1966 | Peltier . | |
| 3,423,042 | 1/1969 | Lipfert | 242/421.5 |
| 3,540,674 | 11/1970 | Okamura . | |
| 3,603,522 | 9/1971 | Herrmann . | |
| 3,750,968 | 8/1973 | Mochizuki et al. . | |
| 3,822,838 | 7/1974 | Butler et al. | 242/421.7 |
| 3,836,089 | 9/1974 | Riemersma | 242/421.6 |
| 4,283,024 | 8/1981 | Sienkiewicz . | |
| 4,318,513 | 3/1982 | Martinez | 242/421.6 |
| 4,770,366 | 9/1988 | Hood et al. | 242/420.6 |
| 4,899,945 | 2/1990 | Jones . | |
| 4,923,138 | 5/1990 | Malkin | 242/420.6 |
| 4,979,692 | 12/1990 | Julian | 242/420.6 |
| 5,007,597 | 4/1991 | Jones . | |
| 5,100,074 | 3/1992 | Jones . | |
| 5,123,607 | 6/1992 | Jones . | |

*Primary Examiner*—John M. Jillions
*Attorney, Agent, or Firm*—Price, Heneveld, Cooper, DeWitt & Litton

[57] ABSTRACT

A dereeler for selectively feeding coiled stock into an associated fabricating machine has a reel support deck mounted for rotation in a normally horizontal plane. The reel support deck is shaped to support a reel of coiled stock thereon to pay out the coiled stock in a substantially horizontal direction. A motor is operably connected with the reel support deck and selectively rotates the same. A sliding guide arm has a lower end slidably mounted on a slide rail for horizontal translation therealong. The upper end of the guide arm is shaped to guide stock therethrough in a predetermined orientation into the associated fabricating machine. A first control line has one end operably connected to the guide arm and an opposite end operably connected with a controller shaft that is mounted for axial rotation on the dereeler. Extension of the guide arm along the slide rail rotates the controller shaft. A controller is operably connected with the controller shaft and the motor. The controller is configured to activate the motor to rotate the reel support deck to selectively pay out additional stock from the associated reel when the guide arm is extended along the slide rail in response to the feeding of stock into the fabricating machine.

20 Claims, 7 Drawing Sheets

DEREELER FOR SELECTIVELY FEEDING COILED STOCK INTO AN ASSOCIATED FABRICATING MACHINE

BACKGROUND OF THE INVENTION

The present invention relates to a stock feeding apparatus and the like, and in particular to a dereeler that can feed relatively large flat stock into an associated fabricating machine that requires an isolating or intermittent feed requirements.

Various types of metal parts are fabricated from wire or flat stock. This fabrication is often performed by die-stamping or similar processes that have an isolating or intermittent feed rate. These types of fabricating machines often form parts in steps or stages wherein a length of stock is fed in, the forming operation is performed, and the stock is advanced to begin the next cycle. This type of forming operation requires varying feed rates, often alternating in a periodic manner between a short period of relatively high feed rate, followed by a period of low or no feed.

Prior dereelers utilizing a pivoting arm, such as that disclosed in U.S. Pat. No. 4,899,945, are suitable for use with wire, or other small stock which is drawn from the reel or spool in relatively short lengths. Since the length of stock that may be drawn from the reel is limited by the length of the pivoting arm, this type of dereeler is not particularly suitable for applications requiring very long sections of flat stock, which may be drawn from the reel, such as at lengths of 29 inches and greater.

It is often more economical to purchase the stock in relatively large reels or spools. In addition, a larger spool will require replacement with less frequency. However, large spools of stock require substantial force to initiate rotation, and the inertia of the spool causes the stock to continue feeding if stopped suddenly. In addition, as the stock is used from the spool, the weight and corresponding inertia of the spool is substantially reduced. This change in inertia changes the force required to start or stop the spool, depending on the amount of stock remaining on the spool. Finally, since the effective diameter of the stock on the spool changes as the stock is used, maintaining a constant linear feed rate requires an increasing rotational speed of the spool as the stock is used.

It is an object of the present invention to provide an improved dereeler for flat stock, wire and the like that is simple, durable, and is capable of being used with fabricating machines requiring long sections of flat stock. The dereeler accurately orients the stock in its predetermined feed direction, and applies adequate tension in the uncoiled stock to feed quickly and smoothly into the associated fabricating machine. A horizontal guide arm arrangement permits the dereeler to be used in a wide variety of applications, particularly where relatively long lengths of stock must be fed from a coil.

The principal objects of the present invention are to provide a dereeler for selectively feeding coiled stock into an associated fabricating machine that can accommodate intermittent or varying feed rate and stock sizes. Long sections of stock may be drawn from the reel. The dereeler may be used with a wide range of fabricating machines that may require feeding relatively short or long sections of stock. The length of the slide may be increased if required for very long sections of stock with only minimal modification of the chains and related parts.

SUMMARY OF THE PRESENT INVENTION

A dereeler for selectively feeding coiled stock into an associated fabricating machine has a reel support deck mounted for rotation in a normally horizontal plane. The reel support deck is shaped to support a reel of coiled stock thereon to pay out the coiled stock in a substantially horizontal direction. A motor is operably connected with the reel support deck and selectively rotates the same. A sliding guide arm has a lower end that is slidably mounted on a slide rail for horizontal translation therealong. The upper end of the guide arm is shaped to guide stock therethrough in a predetermined orientation into the associated fabricating machine. A control line has one end operably connected to the guide arm, and an opposite end operably connected with a controller shaft that is mounted for axial rotation on the dereeler. Extension of the guide arm along the slide rail rotates the controller shaft. A controller is operably connected with the controller shaft and the motor. The controller is configured to activate the motor to rotate the reel support deck to selectively pay out additional stock from the associated reel when the guide arm is extended along the slide rail in response to the feeding of stock into the fabricating machine.

These and other features, objects and advantages of the present invention will become apparent upon reading the following description thereof together with reference to the accompanying drawings.

DETAILED DESCRIPTION OF THE PREFERRED EMBODIMENT

Figure 1:
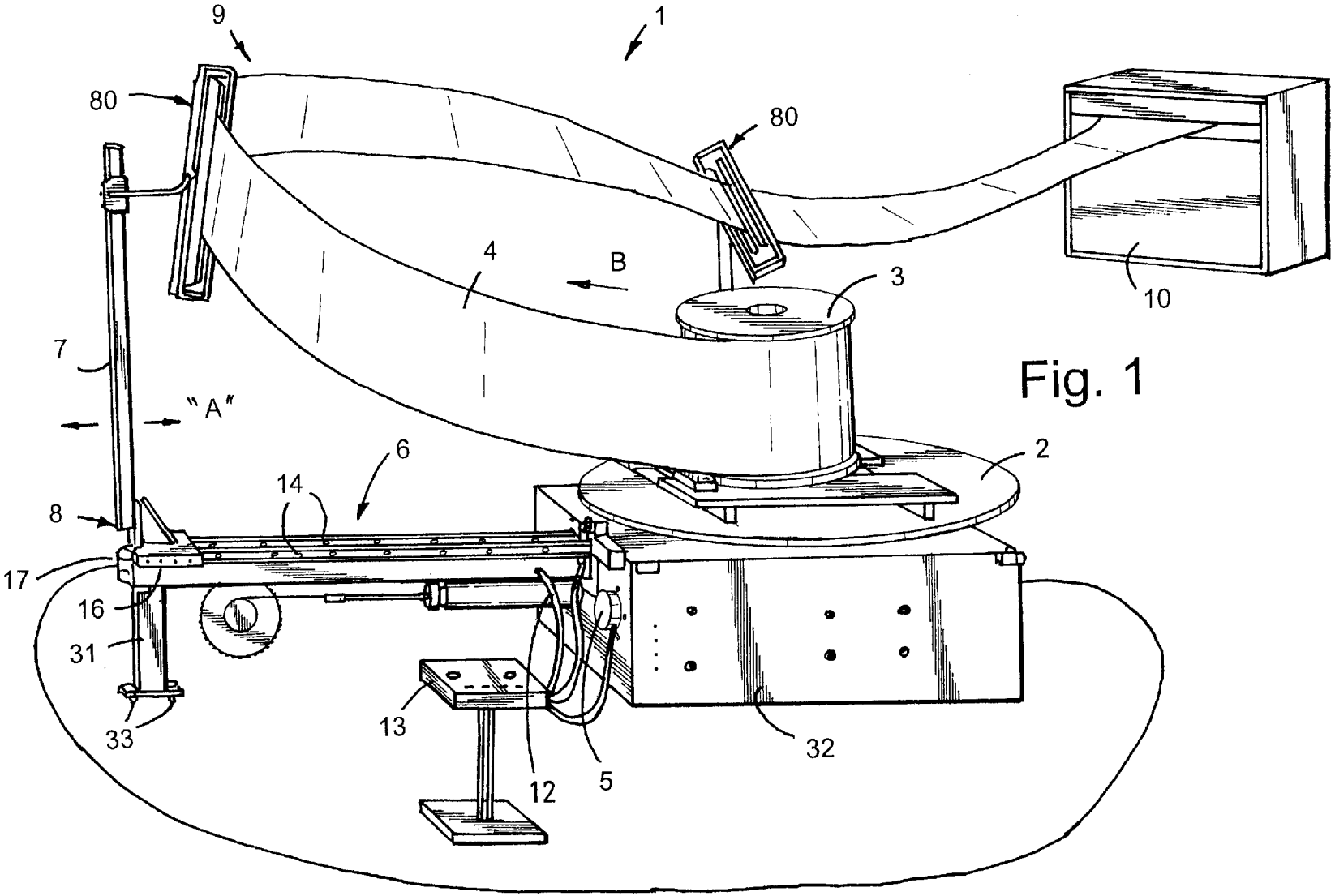
FIG. 1 is a partially schematic, fragmentary, side perspective view of a dereeler embodying the present invention, shown with an associated fabricating machine.

For purposes of description herein, the terms "upper", "lower", "right", "left", "rear", "front", "vertical", "horizontal", and derivatives thereof shall relate to the invention as oriented in FIG. 1. However, it is to be understood that the invention may assume various alternative orientations and step sequences, except where expressly specified to the contrary. It is also to be understood that specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIGS. 1, 2) generally designates a dereeler for selectively feeding coiled stock embodying the present invention, which is designed to be used in conjunction with fabrication machinery, such as a die-press, or the like. As best seen in FIG. 1, the present invention includes a reel support deck 2 which is mounted for rotation in a normally horizontal plane. The reel support deck 2 is shaped to support a reel of coiled stock 3, and is oriented to pay out the coiled stock 4 in a substantially horizontal direction, indicated by the arrow "B" (FIG. 1). A motor 5 is operably connected with the reel support deck 2, and selectively rotates the same. A slide rail 6 is supported in a normally horizontal orientation. A sliding guide arm 7 has a lower end slidably mounted on the slide rail 6 for translation therealong. The upper end 9 of the guide arm 7 is shaped to guide the stock 4 therethrough in a predetermined orientation into the associated fabricating machine 10. A control line such as chain 12 (FIG. 2) has one end thereof operably connected with the guide arm 7, and an opposite end operably connected with a controller shaft 11 which is mounted on the dereeler for axial rotation. Extension of the guide arm 7 along the slide rail 6 rotates the controller shaft 11. A controller 13 is operably connected with the controller shaft 11 and the motor 5. The controller 13 is configured to activate and deactivate the motor 5 to rotate the reel support deck 2 to selectively pay out additional stock 4 from the associated reel 3 when the guide arm 7 is extended along the slide rail 6 in response to feeding of stock 4 into the fabricating machine 10.

With reference to FIGS. 1–4, the slide rail 6 includes a pair of elongate "C" shaped rails 14 and a rectangular tube 16. An elongate flat plate 17 is welded to the top of the rectangular tube 16, and includes threaded apertures 30 for receiving screws 18 to retain angle brackets 19 to the plate 17. Screws 20 retain the elongate rails 14 to the angle brackets 19. The slide rail 6 is supported by a leg 31 at one end, and is attached to the base 32 at the other end. Screws 33 are located at the lower end of leg 31, and provide height adjustment therefor.

Figure 3:
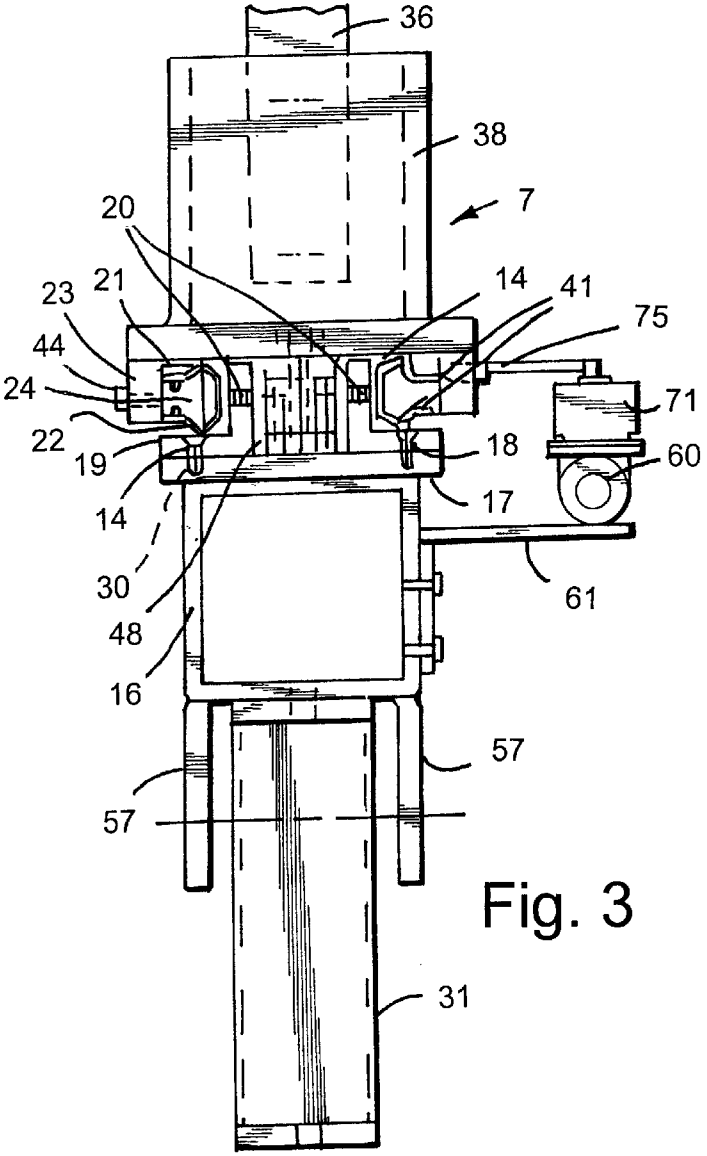
FIG. 3 is a fragmentary, end view of the slide rail and lower end of the guide arm.
Figure 4:
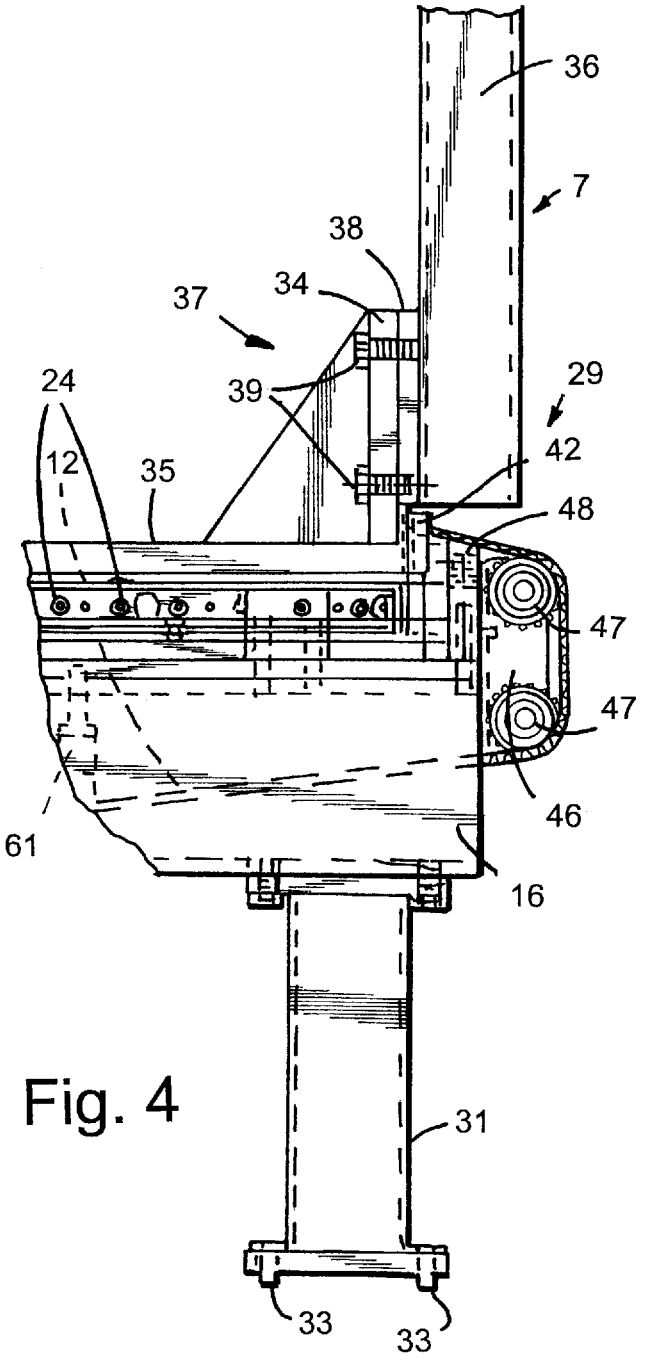
FIG. 4 is a fragmentary, side elevational view of the slide rail and lower end of the guide arm.

With reference to FIGS. 3 and 4, the guide arm 7 includes a rectangular tube 36 that has a plate 38 welded to a vertical face at the lower end thereof. Screws 39 retain the guide arm 7 to bracket 37. A roller and rail arrangement slidably retains the guide arm 7 to the slide rail 6, thereby allowing the guide arm 7 to move freely along the slide rail 6 in the direction indicated by arrow "A" in FIGS. 1 and 4. The rails 14 are generally C-shaped, and have elongate V-shaped grooves 41 on the horizontal upper and lower legs 21, 22 respectively. An extension piece 23 is welded to the lower surface of horizontal plate 35 along each edge thereof. Screws 24 retain the wheels or rollers 44 to the extensions 23. Each of the wheels 44 has a V-shaped outer surface that corresponds to the V-shaped groove 41 in the rails 14. The vertical spacing between the V-shaped grooves 41 of the rails 14 is slightly larger than the outside diameter of the rollers 44 such that each roller only makes contact with either the upper or the lower V-shaped groove 41. Alternating rollers 44 are spaced upwardly and downwardly slightly such that the alternating rollers contact the upper and lower V-shaped grooves 41, respectively. The rails and roller assembly are manufactured by ROLLON S.p.A, Via G, DiVittorio 307-23, 20099 Sesto S, Giovanni -M-Italy, distributed by O.F.B. and Associates, 253 Woodlake Drive, Brighton, Mich. In a preferred embodiment, one of the rails is a "U" style, 800 mm Rail, part number UL43-800, and the other rail is a "T" style, 800 mm Rail, part number TL43-800. The "U" rail has a small flat portion (not shown) at the base of each groove 14 to provide "float" or clearance to help prevent binding if the rails are not precisely parallel. The corresponding roller assembly is part number CSW43-230-22.

The roller and rail slide arrangement locates the guide arm 7 securely, preventing vertical movement, and also providing a low friction rolling contact regardless of whether an upward or downward force is applied along one side of the guide arm 7. For example, if a side load is applied to the upper end of the guide arm 7, the rollers along one side of the bracket 37 will react an upward force into the rail 14, whereas the rollers 44 on the other side of the bracket 37 will react a downward force into the rail 14 on that side. However, because alternating rollers on each side contact either the top or bottom rail, this will not cause binding or excessive friction. Although the embodiment just described is presently preferred, numerous types of linear bearings are available that could be utilized for the slide without substantially changing the function or result of this device.

A pair of L-shaped angle brackets 46 rotatably support two small gears or pulleys 47 near the outer end of the slide rail 6. A stop 48 is bolted to the flat plate 17 to prevent translation of the guide arm 7 beyond a fully retracted position 29 at the end of the slide rail 6. A block 42 is bolted to the horizontal plate 35 of bracket 37 to attach the end of chain 12 to the slide arm 7.

Figure 2:
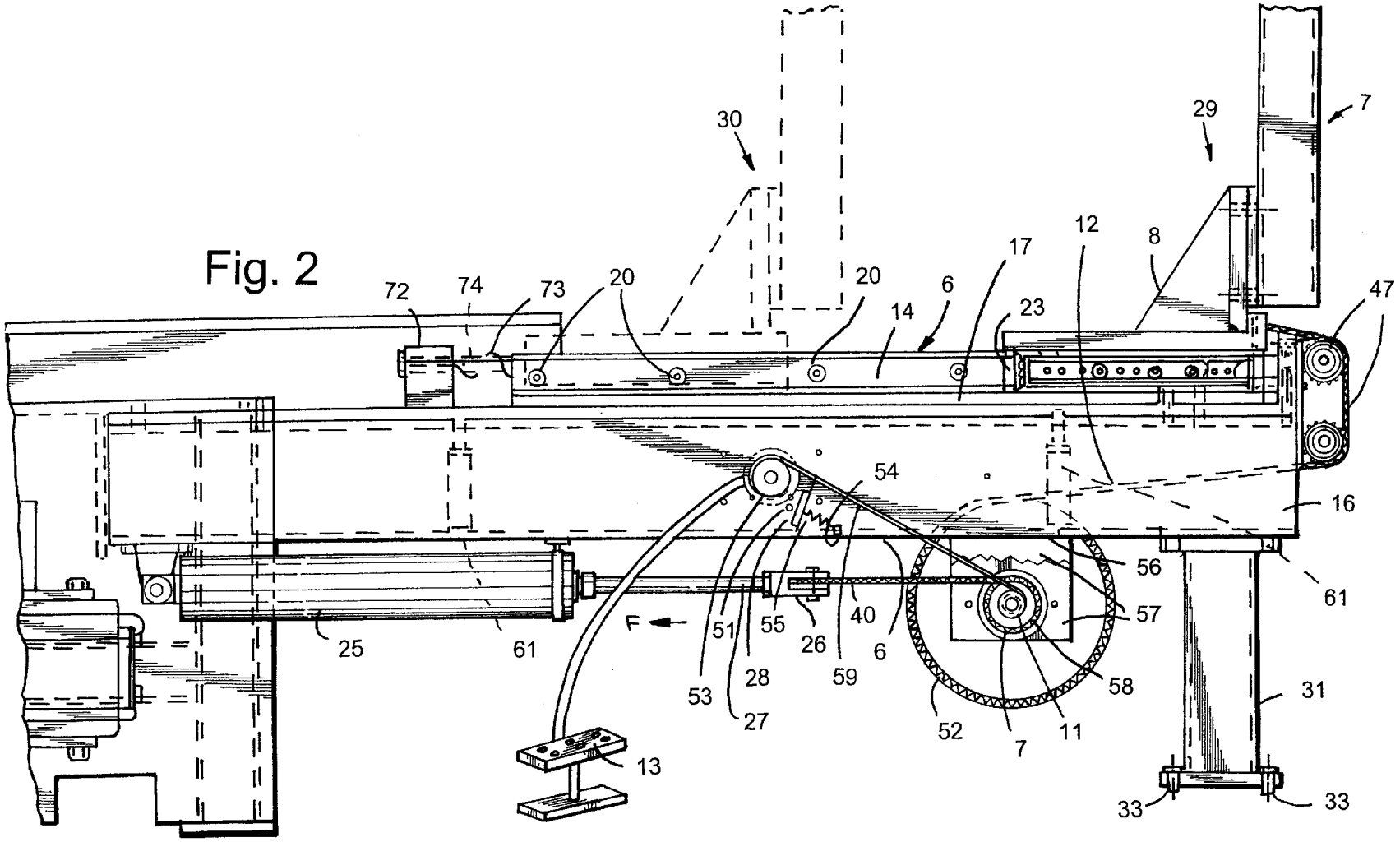
FIG. 2 is a fragmentary, side elevational view of the slide rail portion of the dereeler, showing the mounting of a potentiometer.

With reference to FIGS. 1 and 2, an arm return assembly includes a wheel such as a pulley or gear, a control line such as a cable or chain, and counterforce arrangement to automatically shift the guide arm 7 to a fully retracted position 29. The first control line, such as chain 12, has one end attached to the guide arm 7, and the other end wound around and attached to a large first pulley or gear 52. The intermediate portion of first control line 12 is supported by the small pulleys or gears 47 which cooperate to provide a tension force urging the guide arm 7 towards the fully retracted position 29. Small gears 47 also align the control line 12 with the guide arm 7 and the open end of the tube 16. The first gear 52 is rotatably mounted to a pair of support plates 57 which are welded to the lower side of rectangular tube 16. The rectangular tube 16 includes a cut-out portion 56 which receives an upper portion of the pulley 52, thereby aligning the top edge of the first pulley 52 with the first control line 12 that is disposed along the interior of the rectangular tube 16. A second control line such as chain 40 has one end attached to clevis 26 of a pneumatic or air cylinder 25, and the second end wound around, and attached to a second pulley or gear 58. Both the first gear 52 and the second gear 58 are fixed to the controller shaft 11 and rotate therewith. The first gear 52 is substantially larger than the second gear 58, such that a horizontal movement of the guide arm 7 results in a relatively small corresponding movement of the shaft 27 of the air cylinder 25. The air cylinder 25 is pressurized to bias it into a retracted position, thereby generating a tension force acting on the chain 40 in the direction of arrow "F" (FIG. 2), and biasing the guide arm 7 towards the retracted position 29. The air pressure in cylinder 25 may be changed to adjust the tension on the first control line or chain 12 as required for varying stock sizes, feed rates and other operating conditions. The tension provided by the air cylinder 25 maintains the stock flat and properly oriented during operation. In an alternative embodiment described in more detail below, the counterforce mechanism utilizes an adjustable counterweight to generate tension in the chain 40 to bias the guide arm 7 towards the fully retracted position. In addition, the chain and gear arrangement can be replaced by a cable and pulley arrangement without substantially changing the function or result.

A rotary potentiometer 53 is operably connected to the guide arm 7, and acts as a sensor to generate a signal as the guide arm 7 translates along the slide rail 6. A third control line such as cable 59 is wrapped around, and attached directly to the controller shaft 11 at one end, and wraps around a rotary potentiometer 53 mounted to the outside of tube 16 at a midpoint. A tension spring 55 is attached to the other end of the third control line or cable 59 and to an anchor point 54, such as a screw, located on the rectangular tube 16. The rotary potentiometer 53 is operably connected to the controller 13 such that the rotation rate of the reel support deck 2 increases in direct proportion to the position of the guide arm 7 along the slide 6. The reel support deck 2 rotates at a higher r.p.m. when the guide arm 7 is in the extended position 30, and rotates at a lower r.p.m. when the guide arm 7 is in the retracted position 29. The potentiometer generates a signal that increases the rotation rate of the reel support deck 2 in proportion to the angular position of the potentiometer 53. As the potentiometer 53 rotates from about 0° to 360°, the r.p.m. of the reel support deck 2 increases from zero to maximum r.p.m. However, if the potentiometer 53 continues to rotate past the maximum r.p.m. position, the potentiometer will go directly from the maximum r.p.m. to zero r.p.m. Since this is undesirable if the slide arm 7 is approaching the fully extended position 30 where maximum r.p.m. is required, a stop block 28 and stop clamp 51 may be used to prevent rotation of the potentiometer past the maximum r.p.m. position. Stop clamp 51 is adjustably clamped to the third control line 59 and contacts the stop block 28 as the control arm 7 approaches the extended position 30 to release the tension on the third control line 59 generated by the spring 55, thereby preventing the potentiometer from rotating past the maximum r.p.m. position. In addition, the controller 13 may be configured to vary the r.p.m. of the reel support deck 2 in a non-linear, preprogrammed manner, rather than the linear, direct proportion relationship just described.

As illustrated in FIG. 2, the slide rail 6 includes a plunger 74 which slidably extends through a bore in a block 72. A spring 73 biases the plunger 74 outwardly. If the guide arm 7 reaches the fully extended position 30 as a result of an increase in the feed rate, the spring 73 absorbs the shock to prevent damage to the dereeler.

An elongate rod 60 is attached to the tube 16 by a pair of brackets 61. The rod 60 is located adjacent, and parallel to, the slide 6 and provides an adjustable support for limit switch 71. Limit switch 71 includes a pivot arm 75 that contacts extension 23 of the guide arm 7 to generate a signal to the controller 13. The limit switch 71 may be mounted adjacent the extended position 30 to generate a signal if the guide arm 7 approaches the extended position 30 due to high feed rate by the associated fabricating machine 10. Actuation of the limit switch 71 generates a signal to the controller 13 which may be configured to turn off the fabricating machine 10 to prevent damage to the dereeler or fabricating machine.

Figure 5:
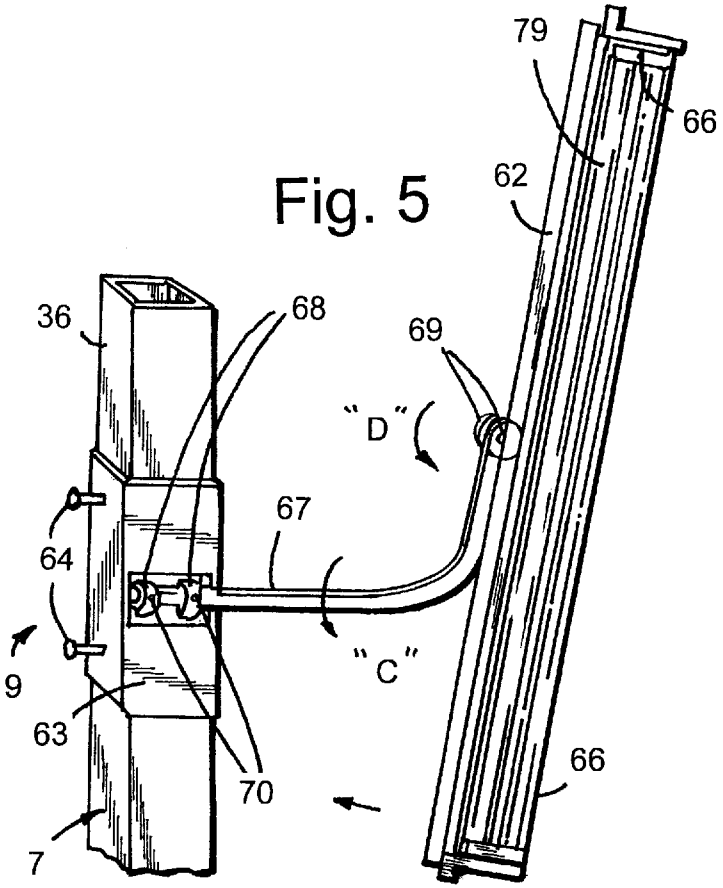
FIG. 5 is a fragmentary, perspective view of the upper end of the guide arm showing a roller guide.

With reference to FIG. 5, the upper end 9 of the guide arm 7 includes a guide mechanism 80 having a frame 62 which is adjustably attached to the upright rectangular tube 36. First and second long rollers 65 and 79, respectively, and a pair of short rollers 66 are rotatably attached to the frame 62 for guiding flat stock from the reel 3 to the associated fabricating machine 10 during operation. The short rollers 66 are perpendicular to the long rollers 65 and 79, near the ends of the frame 62, and contact the edges of the flat stock. A sleeve 63 fits over the rectangular tube 36 and is secured at the desired height by screws 64. An extension 67 is rotatably mounted to first bearings 68 which are attached to the sleeve 63. This allows rotation of the frame 62 as indicated by arrow "C". Set screws 70 in first bearings 68 lock the extension 67 at the desired orientation relative to the sleeve 63. The other end of the extension 67 is rotatably attached to the frame 62 by second bearings 69. The frame 62 rotates about bearings 69 in the direction of arrow "D". The combined adjustability of the movement of the sleeve 63 along the rectangular tube 36, and the rotation of the extension 67 at the attachment to the sleeve 63 and the frame 62 allows the rollers to be adjusted for a range of stock sizes and operating conditions. As illustrated in FIG. 1, another guide mechanism 80 is mounted to the base 32 to further assist support of the stock 4.

Figure 6:
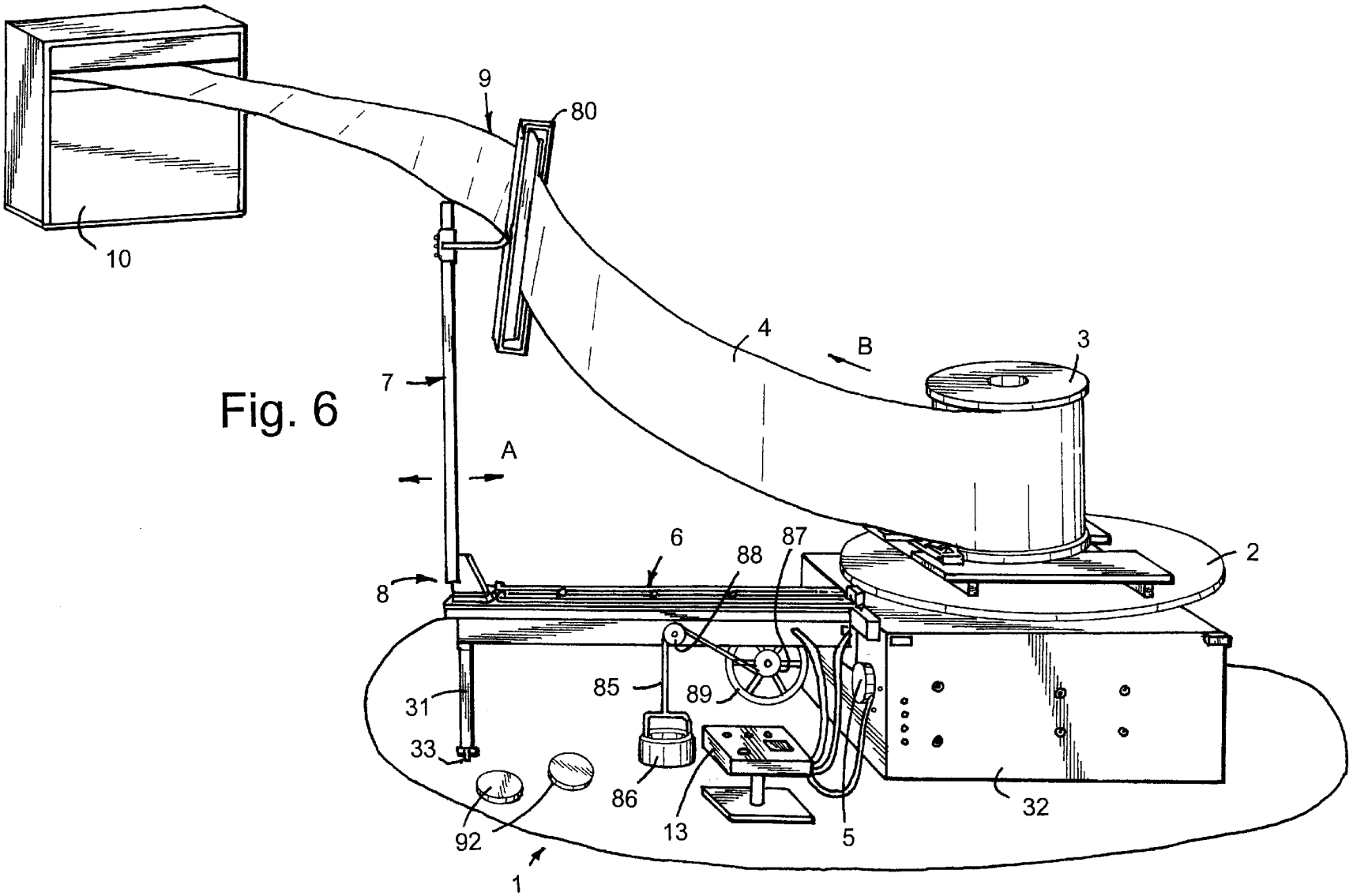
FIG. 6 is a partially schematic, fragmentary, side perspective view of an alternative embodiment of a dereeler embodying the present invention, shown with an associated fabricating machine.
Figure 7:
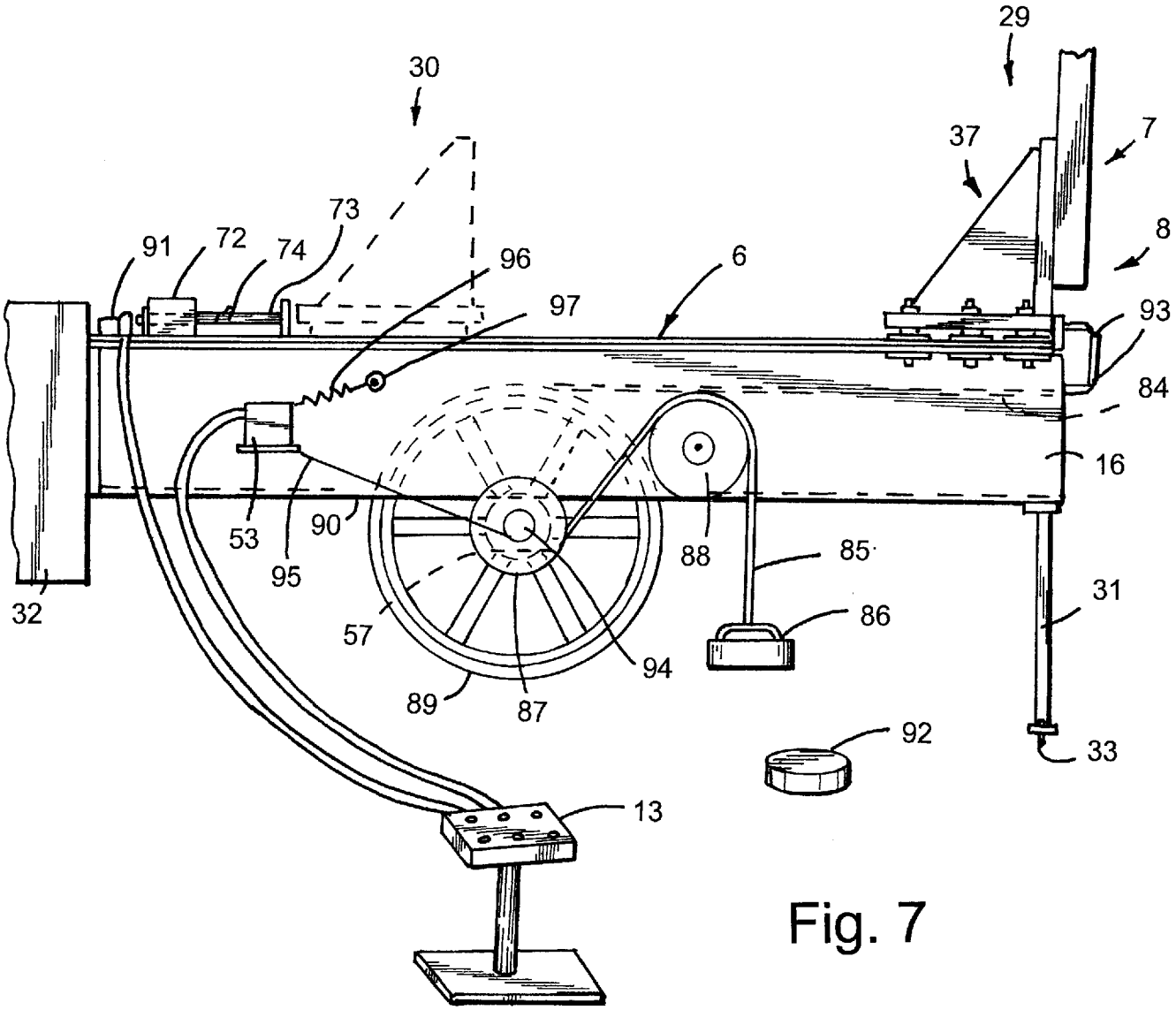
FIG. 7 is a fragmentary, side elevational view of an alternative embodiment of the dereeler having an adjustable counterweight mechanism.

An alternative embodiment of the dereeler mechanism is illustrated in FIGS. 6–9. This embodiment is similar to the embodiment described above, except that the counterforce is provided by a counterweight, pulley, and cable arrangement rather than the pneumatic cylinder, chain and sprocket arrangement. In addition, the slide rail utilizes V-shaped guide rails and pulleys to guide the guide arm rather than the C-shaped rails 14 of the previously described embodiment. Finally, a single guide mechanism 80 is utilized in this embodiment (FIG. 7).

With reference to FIGS. 6 and 7, the counterforce mechanism of the alternative embodiment utilizes a second line such as a cable 85 that is connected to a weight basket 86 at one end, and is wrapped around and attached to a wheel such as pulley 87. An idler pulley 88 is rotationally mounted to the outside of the rectangular tube 16, and provides clearance for vertical movement of the weight basket 86 during operation of the dereeler. A first control line such as cable 84 is wound around, and attached to a large pulley 89 at one end, and is attached to the guide arm 7 at the other end. The large pulley 89 is fixed to a shaft 94 that is rotatably mounted adjacent the bottom side of the rectangular tube 16 by support plates 57. The pulley 87 is also fixed to the shaft 94, such that the force generated by the weight 92 in the weight basket 86 is transmitted to the guide arm 7, biasing the guide arm 7 into the fully retracted position 29. The large pulley 89 extends upwardly through a clearance aperture 90 in the bottom of the rectangular tube 16. A pair of small wheels such as pulleys 93 support the first cable 84, and align cable 84 with the large pulley 89 and the guide arm 7.

In this embodiment, the potentiometer 53 is mounted to the side of rectangular tube 16. A line 95 is wrapped around the shaft 94 at one end, and is attached to a spring 96 at the other end. The spring 96 is attached to the side of the rectangular tube 16 by an anchor such as a screw 97. Movement of the guide arm 7 along the slide rail 6 causes rotation of the large pulley 89 and the potentiometer 53. The controller 13 rotates the reel support deck 2 at a higher r.p.m. when the guide arm 7 is in the extended position 30. The increased rotation rate of the reel support deck 2 as the guide arm 7 moves toward the fully extended position 30 compensates higher feed rates.

Figure 8:
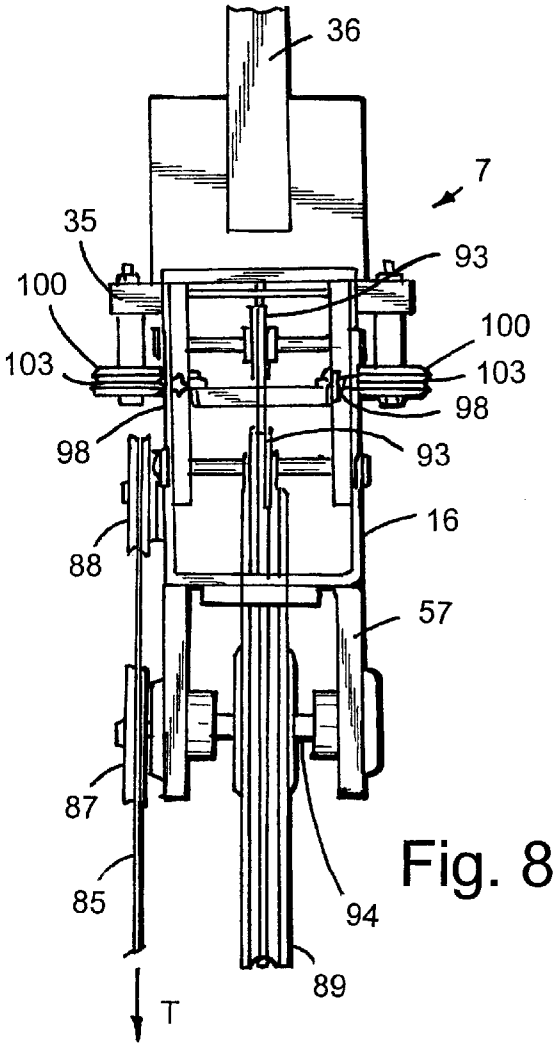
FIG. 8 is a fragmentary, end view of the slide rail and lower end of the guide arm of the alternative embodiment of FIG. 7.
Figure 9:
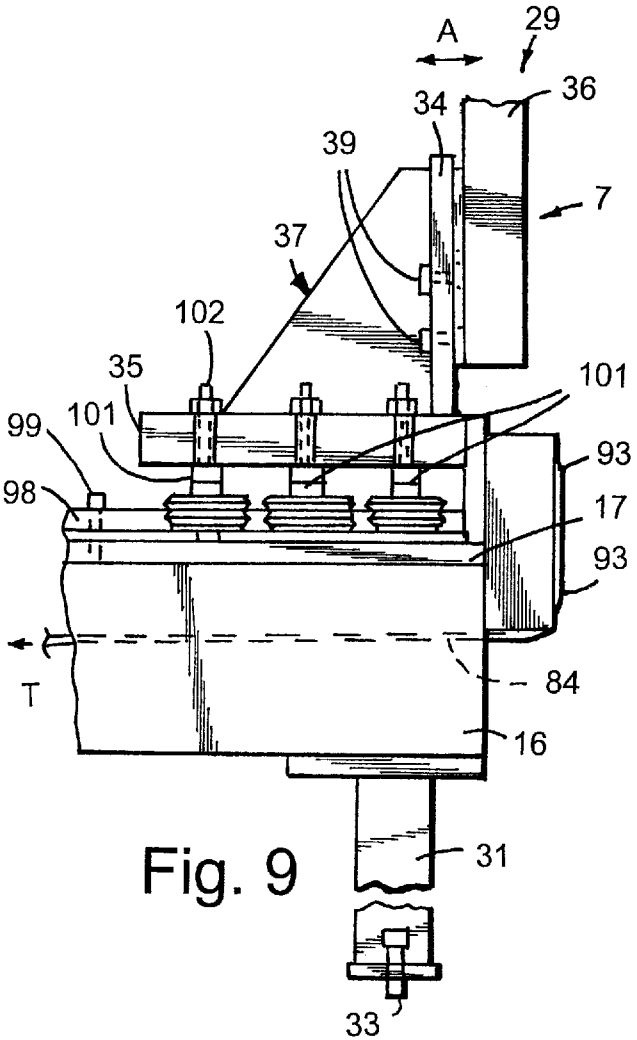
FIG. 9 is a fragmentary, side elevational view of the slide rail and lower end guide arm of the alternative embodiment of FIG. 7.

With reference to FIGS. 8 and 9, in this embodiment the slide 6 includes a pair of V-shaped rails 98 that are fastened to the plate 17 by screws 99. The V-shaped portions of the rails 19 face outwardly, and correspond to the outer, annular groove 103 in the V-shaped wheels 100. A total of six V-shaped wheels 100 are fastened to the bracket 37. The V-shaped wheels 100 are rotatably mounted by means of spacers 101 and bolts 102. As illustrated in FIG. 7, a limit switch 91 is attached to the slide rail 6 adjacent the base 32. A plunger 74 is slidably mounted in a block 72, and biased towards the guide arm 7 by a spring 73. If the associated fabricating machine 10 begins to feed stock at a very high rate, causing the guide arm 7 to move to the fully extended position 30, the guide arm 7 moves the plunger 74, actuating the limit switch 91. The controller 13 then shuts down the fabricating machine 10 and the reel support deck 2 to prevent damage due to the excessive stock feed rate.

In the embodiment illustrated in FIGS. 6–9, the tension "T" (FIGS. 8 and 9) may be varied by placing the desired number of weights 92 into the weight basket 86 to thereby compensate for varying stock sizes, feed rates and related operating variables.

During operation, the fabricating machine 10 begins to advance a section of the stock 4, thereby increasing the tension in the stock. As a result, the guide arm 7 will translate towards the reel support deck 2, overcoming the force generated by the counterforce operating through the control lines, and accurately feeding the uncoiled stock 4 into the fabricating machine 10 in a predetermined orientation and pretension. Translational movement of the guide arm 7 rotates the controller shaft 11, causing the rotary potentiometer to generate a signal that is fed to the controller 13, which in turn generates a signal to the motor 5 to increase the rotational speed of the reel support deck 2. The increase in rotational speed causes a higher feed rate of the stock 4, which in turn maintains the tension the stock 4 at a relatively constant level. The controller 13 may be programmed to vary the rotational speed of the reel support deck 2 in response to changes in the tension of the stock 4 as required, depending on the feed rate, variations in the feed rate, the size of the stock 4 being used for a particular application, and other similar variables.

The slide rail 6 of the present dereeler can accommodate a variety of feed requirements, including longer or shorter lengths of stock. In addition, the present dereeler is also adaptable for use with a virtually unlimited range of feed lengths without extensive modification of the overall design. For applications requiring longer lengths of stock, the slide rail 6 and the first control line 12 may be lengthened as required, thereby allowing use of the dereeler with very long lengths of stock.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A dereeler for selectively feeding coiled stock into an associated fabricating machine, comprising:

a reel support deck mounted for rotation in a normally horizontal plane, and shaped to support a reel of coiled stock thereon oriented to pay out the coiled stock in a substantially horizontal direction, said reel support deck having a horizontal dimension sufficient to support the reel of coiled stock;

a motor operably connected with said reel support deck, and selectively rotating the same;

a slide rail supported in a normally horizontal orientation;

a sliding guide arm having a first end thereof slidably mounted on said slide rail for translation therealong, and an opposite end thereof shaped to guide stock therethrough in a predetermined orientation into the associated fabricating machine said guide arm translating between a retracted position wherein said guide arm is positioned adjacent said reel support deck, and an extended position wherein said guide arm is spaced-apart from said reel support deck, said retracted and extended positions defining therebetween a guide arm travel distance, wherein said guide arm travel distance is larger than said horizontal dimension of said reel support deck, such that during operation of said dereeler, said guide arm extends along said slide rail in response to varying feed rates of the stock, thereby permitting said reel support deck to rotate at a relatively constant rate despite variations in the feed rate of the stock;

a controller shaft mounted for axial rotation on said dereeler;

a control line having one end thereof operably connected with said guide arm, and an opposite end thereof operably connected with said controller shaft, such that extension of said guide arm along said slide rail rotates said controller shaft;

a controller operably connected with said controller shaft and said motor, and configured such that extension of said guide arm along said slide rail in response to the feeding of stock into the fabricating machine activates said motor and rotates said reel support deck in a manner to selectively pay additional stock from the associated reel.

2. A dereeler as set forth in claim 1, wherein:

said controller is configured to deactivate said motor, and selectively halt rotation of said reel support deck to alleviate feed overrun of the stock into the fabricating machine; and said slide rail defines a slide axis, and said guide arm is slidably connected to said slide rail by a slide assembly that prevents rotation of said guide arm about said slide axis.

3. A dereeler as set forth in claim 2, wherein:

said guide arm has a fully retracted position, and a fully extended position on said slide rail; and including an arm return automatically shifting said guide arm to said fully retracted position.

4. A dereeler for selectively feeding coiled stock into an associated fabricating machine, comprising:

a reel support deck mounted for rotation in a normally horizontal plane, and shaped to support a reel of coiled stock thereon oriented to pay out the coiled stock in a substantially horizontal direction;

a motor operably connected with said reel support deck, and selectively rotating the same;

a slide rail supported in a normally horizontal orientation;

a sliding guide arm having a first end thereof slidably mounted on said slide rail for translation therealong, and an opposite end thereof shaped to guide stock therethrough in a predetermined orientation into the associated fabricating machine;

said guide arm having a fully retracted position, and a fully extended position on said slide rail;

an arm return automatically shifting said guide arm to said fully retracted position;

a controller shaft mounted for axial rotation on said dereeler;

a control line having one end thereof operably connected with said guide arm, and an opposite end thereof operably connected with said controller shaft, such that extension of said guide arm along said slide rail rotates said controller shaft;

a controller operably connected with said controller shaft and said motor, and configured such that extension of said guide arm along said slide rail in response to the feeding of stock into the fabricating machine activates said motor and rotates said reel support deck in a manner to selectively pay additional stock from the associated reel;

said controller configured to deactivate said motor, and selectively halt rotation of said reel support deck to alleviate feed overrun of the stock into the fabricating machine;

said control line defining a first control line; and said arm return including a pneumatic cylinder, and a second control line having one end thereof operably connected with and wound about said controller shaft and an opposite end thereof operably connected with said pneumatic cylinder, whereby forces generated by said pneumatic cylinder rotate said controller shaft and thereby tense said first control line to translate said guide arm to said fully retracted position.

5. A dereeler as set forth in claim 4, wherein:

said arm return includes a first pulley mounted on said controller shaft for rotation therewith; and said opposite end of said first control line is attached to and wound about said first pulley.

6. A dereeler as set forth in claim 5, wherein:

the pressure in said pneumatic cylinder may be changed to allow adjustment of the forces generated by said pneumatic cylinder as required for different stock sizes, feed rates, and fabrication processes.

7. A dereeler as set forth in claim 6, wherein:

said arm return includes a second pulley mounted on said controller shaft for rotation therewith; and said one end of said second control line is attached to and wound about said second pulley.

8. A dereeler as set forth in claim 7, wherein:

said opposite end of said guide arm includes rollers configured to guide flat stock therethrough.

9. A dereeler as set forth in claim 8, wherein:

said fully retracted position and said fully extended positions are adjustable to thereby vary that portion of the rail said guide arm translates along.

10. A dereeler for selectively feeding coiled stock into an associated fabricating machine, comprising:

a reel support deck mounted for rotation in a normally horizontal plane, and shaped to support a reel of coiled stock thereon oriented to pay out the coiled stock in a substantially horizontal direction;

a motor operably connected with said reel support deck, and selectively rotating the same;

a slide rail supported in a normally horizontal orientation;

a sliding guide arm having a first end thereof slidably mounted on said slide rail for translation therealong, and an opposite end thereof shaped to guide stock therethrough in a predetermined orientation into the associated fabricating machine;

a controller shaft mounted for axial rotation on said dereeler;

a control line having one end thereof operably connected with said guide arm, and an opposite end thereof operably connected with said controller shaft, such that extension of said guide arm along said slide rail rotates said controller shaft;

a controller operably connected with said controller shaft and said motor, and configured such that extension of said guide arm along said slide rail in response to the feeding of stock into the fabricating machine activates said motor and rotates said reel support deck in a manner to selectively pay additional stock from the associated reel;

said slide rail defines a slide rail axis and includes two spaced-apart parallel rail members; and said first end of said guide arm includes rollers adapted to rotationally engage said two parallel rail members such that said guide arm translates freely along said slide rail, said rails reacting moments applied to said guide arm, and preventing rotation of said guide arm about said slide rail axis.

11. A dereeler as set forth in claim 10, wherein:

said first pulley is substantially larger than said second pulley such that a horizontal movement of said guide arm results in a relatively small corresponding movement of said pneumatic cylinder.

12. A dereeler for selectively feeding coiled flat stock into an associated fabricating machine, comprising:

a reel support deck mounted for rotation in a normally horizontal plane, and shaped to support a reel of coiled flat stock thereon oriented to pay out the coiled flat stock in a substantially horizontal direction;

a motor operably connected with said reel support deck, and selectively rotating the same;

a slide rail supported in a normally horizontal orientation and defining a slide axis;

a sliding guide arm having a first end thereof slidably mounted on said slide rail for translation therealong, said guide arm mounted to said slide rail with a moment-resisting slide assembly that prevents rotation of said guide arm about said slide axis, and an opposite end thereof having a guide mechanism that contacts the face and edges of the flat stock to guide the flat stock therethrough into the associated fabricating machine;

a sensor on said dereeler for generating a signal as said guide arm translates along said slide rail;

a controller operably connected with said sensor and said motor, and configured such that extension of said guide arm along said slide rail in response to the feeding of stock into the fabricating machine activates said motor and rotates said reel support deck in a manner to selectively pay additional flat stock from the associated reel.

13. A dereeler as set forth in claim 12, wherein:

said controller is configured to deactivate said motor, and selectively halt rotation of said reel support deck to alleviate feed overrun of the flat stock into the fabricating machine.

14. A dereeler as set forth in claim 13, wherein:

said guide arm has a fully retracted position, and a fully extended position on said slide rail; and including an arm return automatically shifting said guide arm to said fully retracted position.

15. A dereeler as set forth in claim 12, wherein said guide mechanism includes a first roller that contacts the face of the flat stock, and a second roller that contacts the edge of the flat stock to guide the flat stock therethrough into the associated fabricating machine.

16. A dereeler for selectively feeding coiled flat stock into an associated fabricating machine, comprising:

a reel support deck mounted for rotation in a normally horizontal plane, and shaped to support a reel of coiled flat stock thereon oriented to pay out the coiled flat stock in a substantially horizontal direction;

a motor operably connected with said reel support deck, and selectively rotating the same;

a slide rail supported in a normally horizontal orientation;

a sliding guide arm having a first end thereof slidably mounted on said slide rail for translation therealong, and an opposite end thereof having a guide mechanism that contacts the face and edges of the flat stock to guide the flat stock therethrough into the associated fabricating machine;

said guide arm has a fully retracted position, and a fully extended position on said slide rail;

an arm return automatically shifting said guide arm to said fully retracted position;

a sensor on said dereeler for generating a signal as said guide arm translates along said slide rail;

a controller operably connected with said sensor and said motor, and configured such that extension of said guide arm along said slide rail in response to the feeding of stock into the fabricating machine activates said motor and rotates said reel support deck in a manner to selectively pay additional flat stock from the associated reel;

said controller configured to deactivate said motor, and selectively halt rotation of said reel support deck to alleviate feed overrun of the flat stock into the fabricating machine;

a controller shaft mounted for axial rotation on said dereeler;

a first control line having one end thereof operably connected with said guide arm, and an opposite end thereof operably connected with said controller shaft;

said arm return includes a counterforce mechanism, and a second control line having one end thereof operably connected with and wound about said controller shaft and an opposite end thereof operably connected with said counterforce mechanism, whereby forces generated by said counterforce mechanism rotate said controller shaft and thereby tense said first control line to translate said guide arm to said fully retracted position.

17. A dereeler as set forth in claim 16, wherein:

said arm return includes a first pulley mounted on said controller shaft for rotation therewith; and said opposite end of said first control line is attached to and wound about said first pulley.

18. A dereeler as set forth in claim 17, wherein:

said counterforce mechanism includes a pneumatic cylinder having adjustable pressure to allow adjustment of the forces generated by said pneumatic cylinder as required for different flat stock sizes, feed rates, and fabrication processes.

19. A dereeler as set forth in claim 18, wherein:

said arm return includes a second pulley mounted on said controller shaft for rotation therewith; and said one end of said second control line is attached to and wound about said second pulley.

20. A dereeler as set forth in claim 19, wherein:

said slide rail is at least 28 inches long to permit feed of very long lengths of flat stock.

* * * * *